US010457052B2

(12) United States Patent
Tsubaki

(10) Patent No.: US 10,457,052 B2
(45) Date of Patent: Oct. 29, 2019

(54) LIQUID DISCHARGE APPARATUS AND IMAGE FORMING APPARATUS

(71) Applicant: Kengo Tsubaki, Kanagawa (JP)

(72) Inventor: Kengo Tsubaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/109,260

(22) Filed: Aug. 22, 2018

(65) Prior Publication Data

US 2019/0077158 A1 Mar. 14, 2019

(30) Foreign Application Priority Data

Sep. 8, 2017 (JP) ..... 2017-173336

(51) Int. Cl.
*B41J 2/165* (2006.01)
*B41J 25/304* (2006.01)
*B41J 25/00* (2006.01)

(52) U.S. Cl.
CPC ..... *B41J 2/16535* (2013.01); *B41J 2/16538* (2013.01); *B41J 2/16547* (2013.01); *B41J 2/16585* (2013.01); *B41J 25/304* (2013.01); *B41J 2002/1655* (2013.01); *B41J 2025/008* (2013.01)

(58) Field of Classification Search
CPC ..... B41J 2/165351; B41J 2/16538; B41J 2/16544; B41J 2/16585; B41J 2/16535
See application file for complete search history.

(56) References Cited

U.S. PATENT DOCUMENTS 4,928,120 A * 10/1990 Spehrley, Jr. ..... 347/33
8,109,600 B2 * 2/2012 Okada ..... 347/33
10,099,494 B2 * 10/2018 Profaca ..... B41J 2/04541

FOREIGN PATENT DOCUMENTS

| | | |
|---|---|---|
| JP | 2008-055780 | 3/2008 |
| JP | 2010-025823 | 2/2010 |
| JP | 2011-183713 | 9/2011 |
| JP | 2013-230644 | 11/2013 |
| JP | 2014-019106 | 2/2014 |
| JP | 2014-065227 | 4/2014 |
| JP | 2014-172382 | 9/2014 |
| JP | 2017-001342 | 1/2017 |
| JP | 2017-100349 | 6/2017 |
| JP | 2017-209844 | 11/2017 |

* cited by examiner

*Primary Examiner* — Juanita D Jackson
(74) *Attorney, Agent, or Firm* — Duft & Bornsen, PC

(57) ABSTRACT

A liquid discharge apparatus includes a plurality of head arrays each including a plurality of liquid discharge heads to discharge a liquid from nozzles onto a medium, a drum to rotate and convey the medium to a position facing the plurality of head arrays, and a wiper to wipe the plurality of liquid discharge heads. The plurality of head arrays is inclined at different angles, and the wiper includes a plurality of wiping surfaces to wipe nozzle surfaces of the plurality of liquid discharge heads of the plurality of head arrays, respectively, the nozzles are formed on the nozzle surfaces, and the plurality of wiping surfaces is inclined at the different angles in accordance with the plurality of head arrays, respectively.

13 Claims, 12 Drawing Sheets

LIQUID DISCHARGE APPARATUS AND IMAGE FORMING APPARATUS

CROSS-REFERENCE TO RELATED APPLICATION

This patent application is based on and claims priority pursuant to 35 U.S.C. § 119(a) to Japanese Patent Application No. 2017-173336, filed on Sep. 8, 2017, in the Japan Patent Office, the entire disclosure of which is incorporated by reference herein.

BACKGROUND

Technical Field

Embodiments of the present disclosure relate to a liquid discharge apparatus and image forming apparatus for discharging droplets on a recording medium held on a peripheral surface of a conveyance drum through a plurality of liquid discharge head arrays radially arranged on an outer periphery of the conveyance drum, and forming an image.

Description of the Related Art

As an image forming apparatus including a liquid discharge apparatus, for example, there is an image forming apparatus including a conveyance drum that holds and conveys a recording medium on a peripheral surface at image recording, a sheet feed tray that feeds the recording medium to the conveyance drum, a sheet ejection tray that receives the recording medium on which an image has been recorded and conveyed on the peripheral surface of the conveyance drum, and a liquid discharge apparatus that discharges droplets through head arrays for forming an image on the recording medium.

The liquid discharge apparatus includes a plurality of head arrays radially arranged on an outer periphery of the conveyance drum, each head array including a plurality of liquid discharge heads in a staggered manner and discharging droplets on the recording medium held on the peripheral surface of the conveyance drum, a maintenance module provided at a rear position of the conveyance drum and performing maintenance so that the liquid discharge heads can discharge the droplets before printing and caps nozzles of the liquid discharge heads when not printing for preventing drying, and a head array moving mechanism that reciprocally moves the plurality of liquid discharge head arrays between a droplet discharge position corresponding to the peripheral surface of the conveyance drum and a position corresponding to the maintenance module.

The maintenance module includes a wind-up web and wiper that wipe nozzle surfaces of the plurality of liquid discharge heads when the head array is moved to the rear position of the conveyance drum by the head array moving mechanism at non-image recording timing, a suction cap that sucks the nozzle surfaces of the plurality of liquid discharge heads to form a meniscus, and moisturizing caps provided by the number of the plurality of droplets discharge heads and maintaining the liquid discharge heads in a moisturized state.

SUMMARY

In an aspect of this disclosure, a novel liquid discharge apparatus includes a plurality of head arrays each including a plurality of liquid discharge heads to discharge a liquid from nozzles onto a medium, a drum to rotate and convey the medium to a position facing the plurality of head arrays, and a wiper to wipe the plurality of liquid discharge heads. The plurality of head arrays is inclined at different angles, and the wiper includes a plurality of wiping surfaces to wipe nozzle surfaces of the plurality of liquid discharge heads of the plurality of head arrays, respectively, the nozzles are formed on the nozzle surfaces, and the plurality of wiping surfaces is inclined at the different angles in accordance with the plurality of head arrays, respectively.

In another aspect of this disclosure, a novel liquid discharge apparatus includes a plurality of head arrays each including a plurality of liquid discharge heads to discharge a liquid from nozzles onto a medium, a drum to rotate and convey the medium to a position facing the plurality of head arrays, and a wiper including a web to wipe nozzle surfaces of the plurality of liquid discharge heads of the plurality of head arrays. The nozzles are formed on the nozzle surfaces. The web has a width to cover the nozzle surfaces of the plurality of liquid discharge heads of one of the plurality of head arrays. The plurality of head arrays is inclined at different angles, and the wiper includes a moving mechanism to move the web from a first position facing the one of the plurality of head arrays to a second position facing another of the plurality of head arrays inclined at a different angle from the one of the plurality of head arrays.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
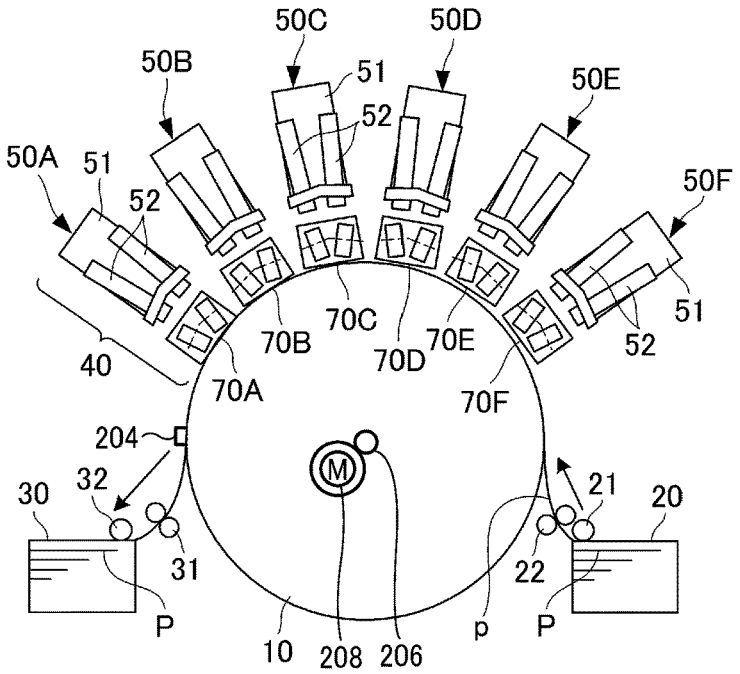
FIG. 1 is a schematic front view of an image forming apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, a liquid discharge apparatus and an image forming apparatus including the liquid discharge apparatus according to embodiments of the present disclosure will be described with reference to the drawings.

First Embodiment

As illustrated in FIG. 1, an image forming apparatus 1 includes a conveyance drum 10 that holds and conveys a recording medium (medium) P on a peripheral surface at image recording, a sheet feed tray 20 on which the recording medium P is stacked, and which feeds the recording medium P to the conveyance drum 10, a sheet ejection tray 30 that receives and stacks the recording medium P on which an image has been recorded and conveyed on the peripheral surface of the conveyance drum 10, and a liquid discharge apparatus 40 that discharges droplets on the recording medium P held on the peripheral surface of the conveyance drum 10.

The conveyance drum 10 has a shaft portion protruding from a drum end surfaces and supported at both ends by an apparatus body configured by front and rear side plates, a stay, and the like, and has one end of the shaft portion 206 coupled to a control motor 208 (a servo motor, for example). The conveyance drum 10 performs rotation at a speed corresponding to a sheet feeding speed, rotation at a speed corresponding to an image forming speed (the rotation at image formation corresponds to main scanning), and rotation at a speed corresponding to a sheet ejection speed when the control motor is driven by a control signal of a controller.

The conveyance drum 10 holds a leading end of the recording medium P sent from the sheet feed tray 20 by a damper 204 provided on the drum side, and conveys the recording medium P, for example. The peripheral surface of the drum is provided with a plurality of small through holes 200 penetrating a negative pressure space portion on a drum inner peripheral side. When the negative pressure space portion becomes a negative pressure state by a negative pressure generation pump 202, the recording medium P is sucked through a plurality of small holes and can be held on the peripheral surface of the drum in a close contact state.

The recording media P stacked on the sheet feed tray 20 are handled by a separation roller 21 and a sheet feed roller 22 and sent one by one to a conveyance portion (a region on a drum upper semi-peripheral surface side between a sheet feed position and a sheet ejection position) of the conveyance drum 10. Further, the image-formed recording media P conveyed to the sheet ejection position on the peripheral surface of the conveyance drum 10 are handled by a sheet ejection roller 31 and a send roller 32 and stacked on the sheet ejection tray 30.

Figure 2:
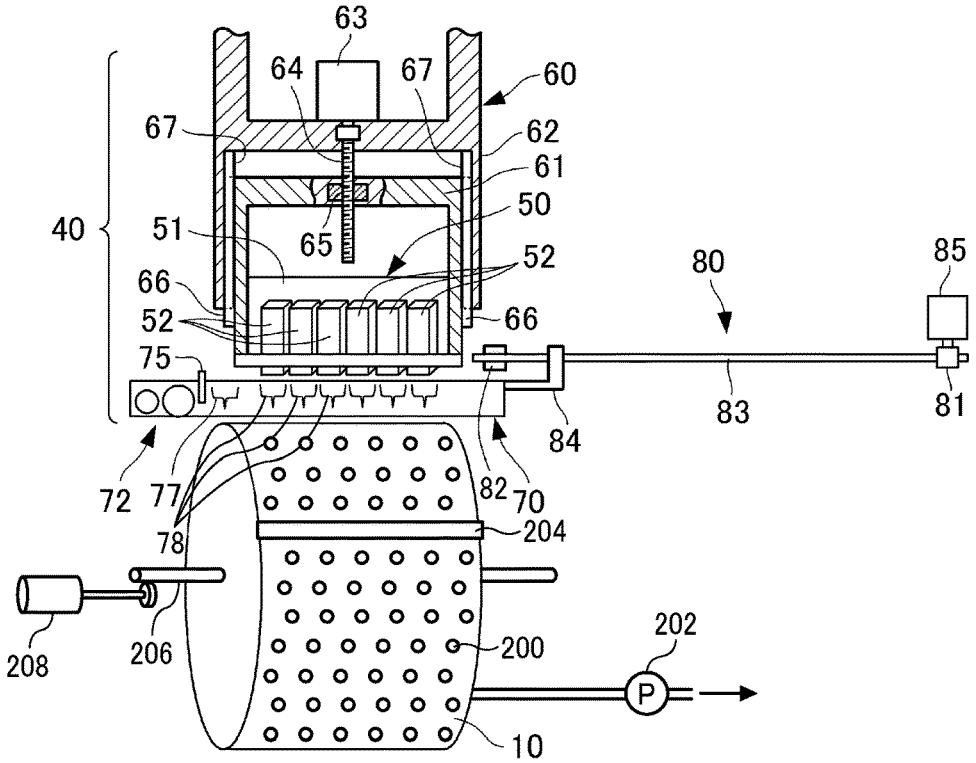
FIG. 2 is a schematic side view of the image forming apparatus at non-image formation timing (when an image is not formed) according to the first embodiment of the present disclosure.

As illustrated in FIGS. 1 and 2, the liquid discharge apparatus 40 includes six head arrays 50A, 50B, 50C, 50D, 50E, and 50F (hereinafter the reference numerals of the head arrays are simply written as 50) radially provided above and outside the peripheral surface, corresponding to the conveyance portion of the conveyance drum 10, a maintenance module 70 corresponding to the head arrays 50, maintenance modules 70A, 70B, 70C, 70D, 70E, and 70F (hereinafter the reference numerals of the maintenance modules are simply written as 70) disposed between the peripheral surface of the conveyance drum 10 and the head arrays 50, corresponding to the head arrays 50, and the maintenance module 70 stopped between the conveyance drum 10 and the head arrays 50.

As illustrated in FIGS. 1 to 4, each head array 50 includes a head array body 51 and a plurality of liquid discharge heads 52 held by the head array body 51.

In each head array body 51, a longitudinal direction (a left-right direction in FIG. 4) coincides with a drum axial direction, and both ends in the longitudinal direction approximately correspond to width ends of the peripheral surface of the conveyance drum 10.

Figure 4:
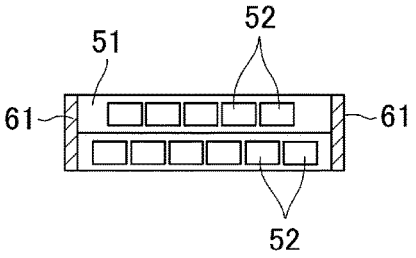
FIG. 4 is a schematic plan view of a head array of the image forming apparatus according to the first embodiment of the present disclosure.

As illustrated in FIGS. 1 and 4, regarding staggered two lines in each head array 50, the liquid discharge heads 52 in one line and the liquid discharge heads 52 in the other line are held in the head array body 51 in a staggered manner (in two lines shifted by half pitch) along a sub-scanning direction (drum axial direction) orthogonal to a main scanning direction that is a drum rotating direction. The configuration of the liquid discharge head 52 includes, as an energy generation source for discharging droplets through the nozzle of the liquid discharge head 52, an energy generation source using a piezoelectric actuator (a stacked piezoelectric element and a thin film piezoelectric element), a thermal actuator using an electrothermal transducer such as a heating resistor, or an electrostatic actuator including a diaphragm and a counter electrode.

In the example illustrated in FIG. 4, the six liquid discharge heads 52 in one line and the five liquid discharge heads 52 in the other line are provided. However, the numbers of the liquid discharge heads 52 are not limited to these numbers. The staggered liquid discharge heads 52 are provided by the number by which the liquid discharge heads 52 can discharge the droplets on a region with a dimension shorter by a slight dimension (1 to 3 mm, for example) from both ends of the peripheral surface of the conveyance drum 10 to form an image.

The head array body 51 is held by a head tank. Since the head array body 51 requires rigidity, the head array body 51 is made of metal such as SUS with the thickness of 6 to 10 mm and is heavy in weight. Each liquid discharge head 52 is coupled to a recording liquid supply tube extending from the head tank by a coupling and held by the head array body 51, and is replaceable when breaks down.

The head tank stores the liquid held in the head array body 51 and discharged as droplets, and communicates with a rear end of each liquid discharge head 52 to supply the liquid. The head tank may be integrated with the liquid discharge head 52, may be integrated with the liquid discharge head 52 via a tube or the like, or may include a filter between the head tank and the liquid discharge head 52.

Regarding the staggered two lines in each head array 50, the liquid discharge heads 52 in one line and the liquid discharge heads 52 in the other line are separated by a required small dimension as viewed from the drum axial direction when the liquid discharge heads 52 are positioned closest to the peripheral surface of the conveyance drum 10, and all of the liquid discharge heads 52 face the center of the drum.

That is, all the liquid discharge heads 52 of the six head arrays 50 are radially disposed such that extended lines of nozzle centers intersect with the center of the drum as viewed from the drum axial direction when the liquid discharge heads 52 are positioned closest to the peripheral surface of the conveyance drum 10. A gap between the nozzle surface of each liquid discharge head 52 and the peripheral surface of the conveyance drum 10 is held to be a uniform and precise small gap so that the droplets can be discharged with an optimum spread from the nozzle surface onto the recording medium P to form a high-quality image.

The six head arrays 50 include a head array that discharges droplets of black (K), a head array that discharges droplets of magenta (M), a head array that discharges droplets of cyan (C), a head array that discharges droplets of yellow (Y), a head array that discharges droplets of a specific color, and a head array that discharges droplets for improving the image quality.

Figure 3:
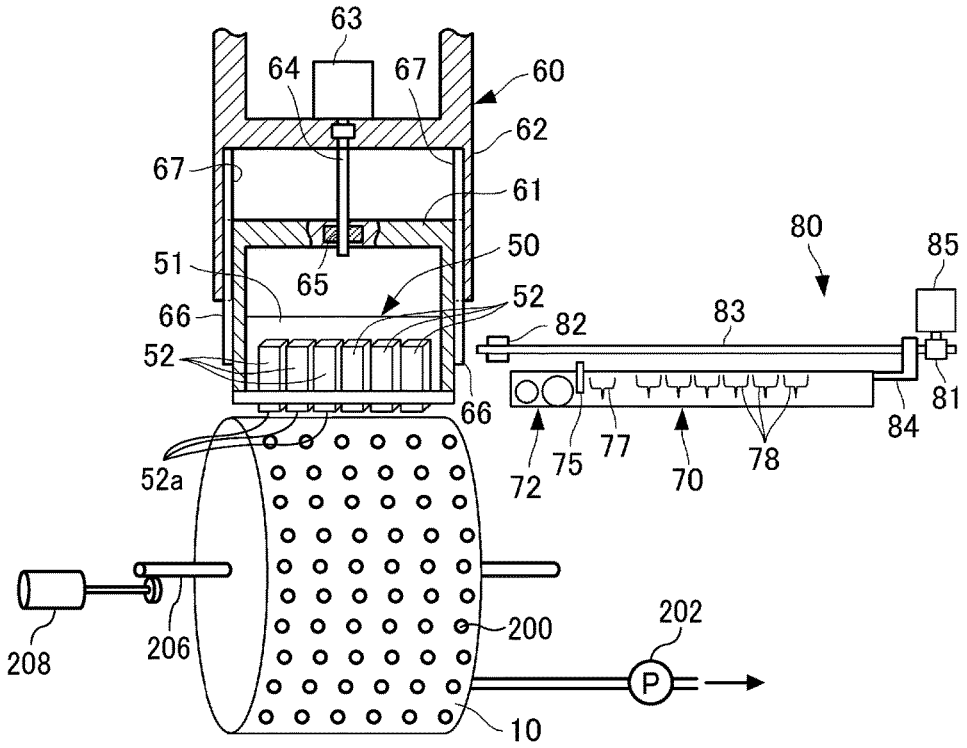
FIG. 3 is a schematic side view of the image forming apparatus at image formation (at liquid discharge timing) according to the first embodiment of the present disclosure.

As illustrated in FIGS. 2 and 3, each of head array moving mechanisms 60 corresponding to the six head arrays 50 includes a lift frame 61 integrally provided with the head array body 51, a secured frame 62 guiding the lift frame 61, a head array movement control motor 63 (second driver) provided on the secured frame 62, a screw shaft 64 that is rotated by the head array movement control motor 63, and a nut runner 65 secured to the lift frame 61 and screwed onto the screw shaft 64.

Further, in each head array moving mechanism 60, a pair of parallel guided units 66 provided at outer ends on both sides of the lift frame 61 and a pair of parallel guiding units 67 provided at inner ends on both sides of the secured frame 62 are engaged, whereby the lift frame 61 is movably guided in a radial direction by the secured frame 62. Then, when the head array movement control motor 63 is driven by the controller, the screw shaft 64 is rotated forward or backward, and the head array 50 approaches to or is separated from the conveyance drum 10 such that a moving direction coincides with the radial direction with respect to the peripheral surface of the conveyance drum 10. As the head array movement control motor 63, a stepping motor or a servo motor is used. As the screw shaft and the nut runner, a ball screw is used.

Figure 5:
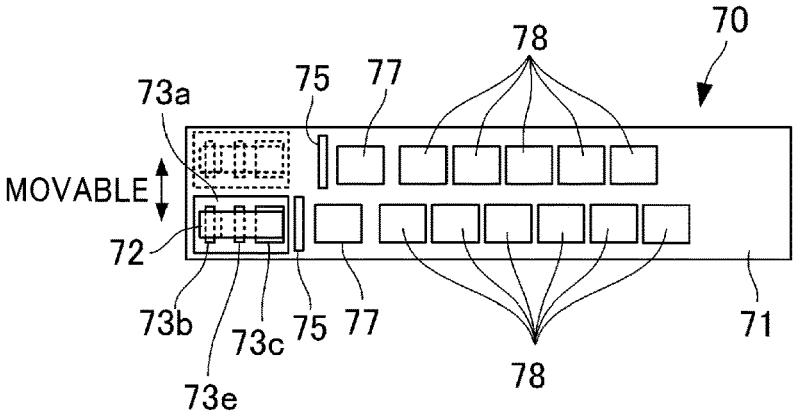
FIG. 5 is a schematic plan view of a maintenance module of the image forming apparatus according to the first embodiment of the present disclosure.

As illustrated in FIG. 5, the maintenance module 70 includes a maintenance module body 71 that is a resin-molded body, and a web 72, a web pressing mechanism 73, a lateral movement mechanism 74, a wiper 75, a wiper driving mechanism 76, a suction cap 77, and a moisturizing cap 78, which are equipped in the maintenance module body 71.

The web 72 has a width corresponding to one line of staggered liquid discharge heads 52, and can wipe the nozzle surfaces of one line of liquid discharge heads 52 by the web pressing mechanism 73 and can be laterally moved by the lateral movement mechanism 74, to wipe the nozzle surfaces of the other one line of liquid discharge heads 52. In contrast, the wiper 75, the suction cap 77, and the moisturizing cap 78 are provided corresponding to the staggered two head arrays and do not require lateral movement.

The web 72 is made of a material having liquid absorbability, favorably, nonwoven fabric, and is pressed against the nozzle surface of the liquid discharge head 52, and absorbs and wipes droplets adhering to the nozzle surface when the maintenance module body 71 is moved in the sub-scanning direction (the direction along the drum shaft) at maintenance.

Figure 6:
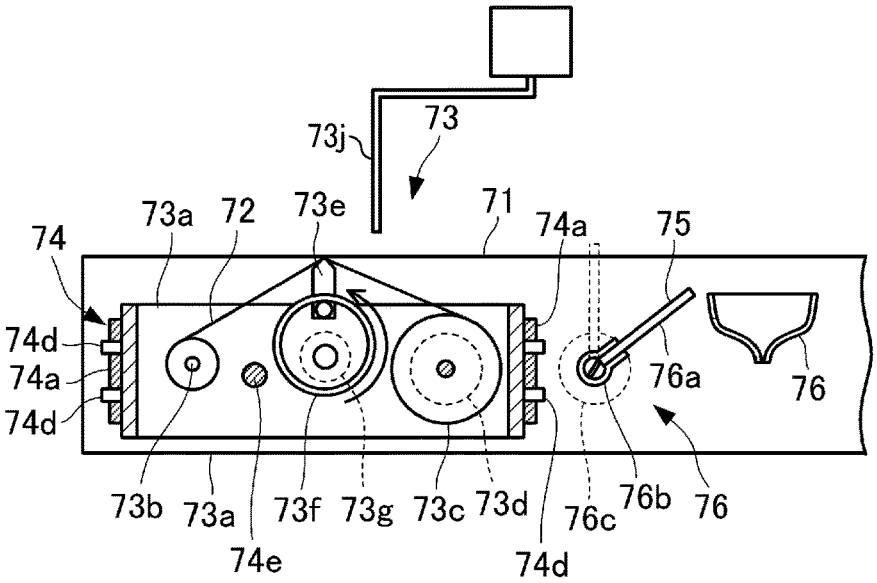
FIG. 6 is a partial vertical cross-sectional view of the maintenance module of the image forming apparatus according to the first embodiment of the present disclosure.
Figure 7:
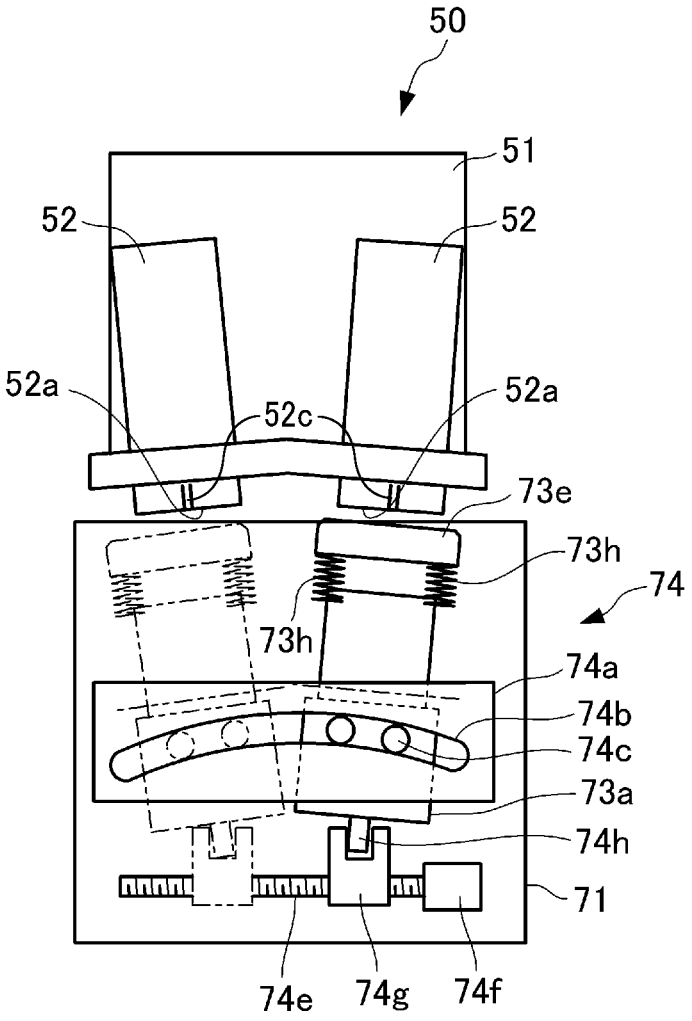
FIG. 7 is a partial vertical cross-sectional view of the liquid discharge apparatus of the image forming apparatus according to the first embodiment of the present disclosure.

As illustrated in FIGS. 6 and 7, the web pressing mechanism 73 includes, in the present embodiment, a bracket 73*a*, a small-diameter send-out shaft 73*b* and a large-diameter wind-up roll 73*c* supported by the bracket 73*a* at both axial ends, a web wind-up motor 73*d* provided on the bracket 73*a* and rotating the wind-up roll 73*c* by a predetermined angle at each wiping, a web pressing body 73*e* movably provided on the bracket 73*a* in a radial direction between the send-out shaft 73*b* and the wind-up roll 73*c*, an eccentric cam 73*f* that pushes up the web pressing body 73*e* outward in the radial direction, an eccentric cam rotation actuator 73*g* held by the bracket 73*a*, and rotates the eccentric cam 73*f* counterclockwise in FIG. 6 by a fixed angle to push up the web pressing body 73*e* and rotates the eccentric cam 73*f* clockwise to return after wiping by the web 72, and a coupling holding portion (spring) 73*h* held by the bracket 73*a* and having a degree of freedom to hold the web pressing body 73*e*. As the web wind-up motor 73*d*, a stepping motor or a servo motor is used.

A cleaning liquid discharge portion 73*j* is provided between the web pressing body 73*e* and the wind-up roll 73*c* and above the web 72, and discharges a several drops of cleaning liquid onto the web 72. The cleaning liquid contains water, an ink pigment-free component, or a component that dissolves a solidified ink.

With this configuration, the web pressing mechanism 73 hooks a send-out end of the web 72 wound around the send-out shaft 73*b* to the wind-up roll 73*c*, and the wind-up roll 73*c* is intermittently rotated by the web wind-up motor 73*d* to wind-up the web 72 by a fixed dimension, so that the portion with the cleaning liquid comes to a tip of the web pressing body 73*e*. As a result, a portion of the web 72, the portion corresponding to the web pressing body 73*e*, is updated, and the updated portion to which the cleaning liquid has been applied by the cleaning liquid discharge portion is pressed against and cleans the nozzle surface of the liquid discharge head 52.

Therefore, the web pressing mechanism 73 can press, with the web pressing body 73*e*, a back surface of an intermediate position of a direct distance of the web 72, the direct distance being from a position where the web is sent out from the send-out shaft 73*b* to a tangential position where the web is wound around the wind-up roll 73*c*, and can press a surface portion at the intermediate position of the web 72 against the nozzle surface of the liquid discharge head 52. With the operation, the web 72 can favorably wipe the droplets adhering to the nozzle surface of the liquid discharge head 52 relatively moved with the movement of the maintenance module body 71.

The web 72 is a consumable item that gets filthy by wiping the head and requires periodic replacement. Since the web 72 comes to a front position of the conveyance drum 10, the replacement work can be easily performed.

In the present embodiment, the web 72 and the web pressing mechanism 73 have following unique configurations.

As illustrated in FIGS. 5 and 7, the width of the web 72 corresponds to the size of the nozzle surface to be wiped of the liquid discharge head 52. The web 72 and the web pressing mechanism 73 equipped in each maintenance module 70 do not have a configuration to simultaneously wipe the nozzle surface of the liquid discharge head 52 in one line and the nozzle surface of the liquid discharge head 52 in the other line held in a staggered manner by the head array body 51, and have a width to wipe the nozzle surface of one line of liquid discharge head 52.

Therefore, as illustrated in FIGS. 6 and 7, the bracket 73*a* holds both ends of the send-out shaft 73*b* and the wind-up roll 73*c* that stretch the web 72 in a tense state, and holds the state in which the web 72 is stretched over the send-out shaft 73*b* and the wind-up roll 73*c* in a tense state. The lateral movement mechanism 74 is provided to laterally move the bracket 73*a*.

The lateral movement mechanism 74 includes an arc-shaped guide portion 74*a* that guides the bracket 73*a* in an arc manner. The arc-shaped guide portion 74*a* includes an arc-shaped slit 74*b* and guides a projection 74*c* provided on the bracket 73*a* in an arc manner by the arc-shaped slit 74*b*.

Further, the lateral movement mechanism 74 includes a screw shaft 74*e* rotatably provided in the maintenance module body 71 in an unmovable state in the axial direction, a lateral movement motor 74*f* that rotates the screw shaft 74*e*, a block 74*g* unrotatably provided on the maintenance module body 71 in a laterally movable state and screwed onto the screw shaft 74*e*, and moved as the screw shaft 74*e* is rotated, and a coupling projection 74*h* provided from the bracket 73*a* and engaged with a recess in the block 74*g* with play.

The web pressing mechanism 73 is operated to push up the web 72 to a level at which the web 72 wipes the nozzle surface of the liquid discharge head 52. The web pressing mechanism 73 is operated in conjunction with the operation of the lateral movement mechanism 74 and the operation of the maintenance module 70, and is further operated in conjunction with a suction operation for the liquid discharge head 52 by the suction cap 77 described below and an operation to wipe the nozzle surface of the liquid discharge head 52 by the wiper 75 described below.

The web 72 wipes droplets adhering to the nozzle surface in combination with the pressing operation by the web pressing body 73*e* and the movement of the maintenance module body 71.

The web pressing mechanism 73 serves a function to raise the web 72 to a height position where the web 72 wipes the nozzle surface of the liquid discharge head 52 by the web pressing body 73*e* at maintenance to wipe the nozzle surface of the liquid discharge head 52 by the web 72.

In the case of wiping all the liquid discharge heads 52 one after another in each line for the staggered two lines of liquid discharge heads 52 by the web 72, the web pressing mechanism 73 keeps the web 72 raised until the web 72 wipes all the liquid discharge heads 52 in one line.

Further, in the case of performing maintenance for all the liquid discharge heads 52 in one line and then for all the liquid discharge heads 52 in the other line to complete the maintenance by the suction cap 77, the web 72, and the wiper 75 for one liquid discharge head 52, the web pressing mechanism 73 lifts up and down the web 72 at each wiping of one liquid discharge head 52 by the web 72.

Further, in the case of alternately performing maintenance for one liquid discharge head 52 in one line and then for one liquid discharge head 52 in the other line in a staggered manner to complete the maintenance by the suction cap 77, the web 72, and the wiper 75 for one liquid discharge head 52, the web pressing mechanism 73 lifts up and down the web 72 at each maintenance of one liquid discharge head 52.

The lateral movement mechanism 74 is operated when switching the web 72 between a position corresponding to the liquid discharge head 52 in one line and a position corresponding to the liquid discharge head 52 in the other line.

In the lateral movement mechanism 74, the web pressing body 73*e* changes the posture of the web 72 to wipably come in close contact with both the nozzle surfaces with different angles from each other of the liquid discharge heads in one line and in the other line in accordance with the bracket 73*a* guided in a curved manner by being guided in an arc manner by the arc-shaped guide portion 74*a* at maintenance. Therefore, the web 72 can favorably come into contact with and effectively wipe both the nozzle surfaces with different angles from each other of the liquid discharge heads 52 in one line and in the other line.

As illustrated in FIGS. 2, 5, and 6, the wiper 75 is made of a material having liquid repellency to the liquid discharged through the nozzle of the liquid discharge head 52, and is a blade-like member having a sharp linear tip with respect to the nozzle surface of the liquid discharge head 52, the tip coming into contact with the nozzle surface, and wipes the nozzle surface with the movement of the maintenance module body 71. The wiping by the wiper 75 is performed after the above-described wiping by the web 72.

As illustrated in FIG. 5, in the present embodiment, there are two wipers 75 in an oblique array and wipes the staggered two liquid discharge heads 52 at the same time.

As illustrated in FIG. 6, each wiper 75 is held by the corresponding wiper driving mechanism 76 and is rotated by a fixed angle, to be movably provided to a non-wiping position and a wiping position with respect to the nozzle surface of the liquid discharge head 52.

In the present embodiment, the wiper driving mechanism 76 includes, for example, a shaft 76*a* supported at both ends by the head array body 51, a bracket 76*b* held by the shaft 76*a* and holding a lower end of the wiper 75, and an electromagnetic or electromotive rotary actuator 76*c* coupled to one end of the shaft 76*a* and rotating the shaft 76*a* to locate an upper end of the wiper 75 to either the non-wiping position (the position in an inclined state by the solid line in FIG. 6) or the wiping position (the position in an inclined position by the chain line in FIG. 6).

The wiper 75 is moved by the wiper driving mechanism 76 and comes into contact with the nozzle surface of the liquid discharge head 52 at maintenance. In this state, the maintenance module body 71 is moved in the drum axial direction with respect to the liquid discharge head 52 by a maintenance module moving mechanism 80, whereby the wiper 75 can scrape the liquid adhering to the nozzle surface and wipe the staggered two liquid discharge heads 52 at the same time.

The wiping by the wiper 75 is performed to clean the ink on the nozzle surface, which could not be removed by the web wiping. Since the wiper 75 also becomes dirty, cleaning and replacement are required. The wiper 75 can come in front of the conveyance drum 10, and thus the cleaning and replacement work can be easily performed.

As illustrated in FIGS. 2, 5, and 6, the suction cap 77 is a trumpet-shaped rubber molded body with a large diameter at an outer end in a radial direction, and has a tube installed in a lower portion, and a suction pump and a waste liquid tank beyond the tube. The suction cap 77 is located at the rear of the wiper 75 on the maintenance module body 71, and sucks two liquid discharge heads 52 in an oblique arrangement at the same time, of the staggered two lines of liquid discharge heads, and forms a meniscus in the tip end in conjunction with stepping of the maintenance module body 71, which is equal to the pitch of the liquid discharge heads 52 and prior to the wiping by the web 72 and up and down movement of the head array body 51.

As illustrated in FIGS. 2, 5, and 6, the moisturizing cap 78 is a trumpet-shaped rubber molded body, and is located at rear of the suction cap 77 on the maintenance module body 71 and provided by the number corresponding to the number of the plurality of liquid discharge heads 52. The moisturizing caps 78 are positioned between the peripheral surface of the conveyance drum 10 and the head array 50, and the head array body 51 comes close to the maintenance module body 71 at non-image formation timing (at non-discharge timing), to come in close contact with the nozzle surfaces of the staggered two lines of all the liquid discharge heads 52, and individually and simultaneously maintain the nozzle surfaces in a moisturized state. Note that the moisturizing cap 78 may be provided to have a size at which one moisturizing cap 78 can surround the plurality of liquid discharge heads 52 of one head array 50.

In this way, the maintenance module 70 is located between the peripheral surface of the conveyance drum 10 and each head array 50 at non-image recording timing (at non-discharge timing), and is reciprocally moved in an axial direction to perform maintenance for the plurality of liquid discharge heads 52 in conjunction with the operation of the conveyance drum 10 to move between the height position to rise by a slight dimension with respect to the maintenance module 70 and the height position to come in close contact with the maintenance module 70.

Figure 8:
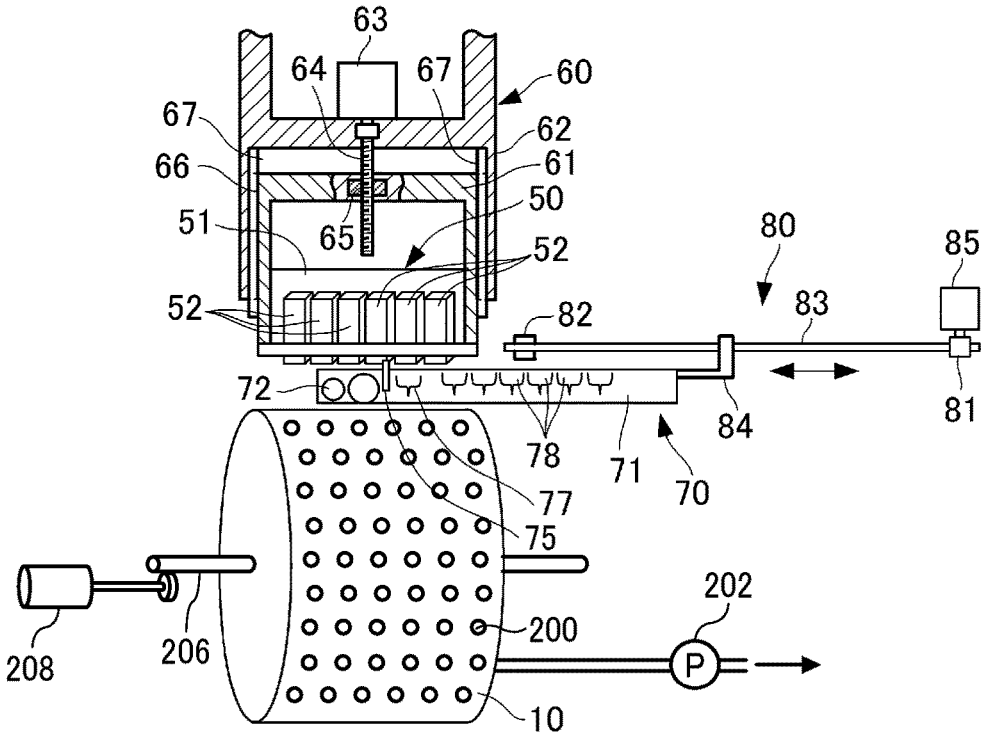
FIG. 8 is a schematic side view of the image forming apparatus at maintenance according to the first embodiment of the present disclosure.

As illustrated in FIGS. 2, 3, and 8, the maintenance module moving mechanism 80 is a mechanism that reciprocally moves the maintenance module 70 in the drum axial direction, and may just be a configuration to stop the maintenance module 70 between the conveyance portion on the peripheral surface of the conveyance drum 10 and the head array 50 at non-image recording timing (at non-discharge timing), perform stepping and reciprocating movement at maintenance, and stop the maintenance module 70 at a rear position in the drum axial direction not to interfere with the head array 50 along the peripheral surface of the conveyance drum 10 at image recording timing (at discharge timing).

In the present embodiment, the maintenance module moving mechanism 80 includes an endless belt 83 stretched around two belt pulleys 81 and 82 arranged in front and rear in the drum axial direction on a drum rear side, a rod-like connecting member 84 connecting a middle of the endless belt 83 and the maintenance module body 71, and a belt driving motor 85 (first driver) that reciprocally rotating one belt pulley 81. As the belt driving motor 85, a servo motor is used.

The maintenance module moving mechanism 80 stops the maintenance module 70 to the position (non-discharge position) between the head array 50 corresponding to the peripheral surface of the conveyance drum 10 and the conveyance drum 10 (see FIG. 2) at non-image recording timing (at non-discharge timing), reciprocally move the maintenance module 70 in the drum axial direction (horizontal direction in FIG. 3) so that the web 72, wiper 75, and the suction cap 77 perform the maintenance of the liquid discharge head 52 before image formation and at maintenance in the middle of image formation (see FIG. 8), and moves and stops the maintenance module 70 at the rear in the drum axial direction so that the head array 50 can come close to the peripheral surface of the conveyance drum 10 at image formation timing at discharge position (at discharge timing) (see FIG. 3).

In the above configuration, a configuration provided with one maintenance module moving mechanism 80, corresponding to one head array 50 has been described. However, the maintenance module bodies 71 of the six head array moving mechanisms 60 may be integrally coupled and one maintenance module moving mechanism 80 may move the six maintenance module bodies 71.

The moving speed of the maintenance module 70 at web wiping is favorably about 50 to 80 mm/s. Since the maintenance module 70 can be suppressed to have a relatively light weight because plastic molding can be used for the maintenance module body 71. Therefore, a small and inexpensive motor can be used as a driving source of the maintenance module moving mechanism 80 for moving the maintenance module 70.

Next, operations of the image forming apparatus 1 and the liquid discharge apparatus 40 having the above-described configuration will be described.

First, one sheet of the recording media P stacked on the sheet feed tray 20 is separated by the separation roller 21 and the sheet feed roller 22 and is supplied to the conveyance drum 10, and the conveyance drum 10 is rotated at a speed in synchronization with a feeding speed of the recording medium P and holds the recording medium P on the peripheral surface of the drum in a close contact state in conjunction with a vacuum action on the peripheral surface of the drum.

Next, the head array 50 is raised by a slight dimension by the head array moving mechanism 60, and when the nozzle surface of the liquid discharge head 52 is thus separated by a few dimension from the moisturizing cap 78 of the maintenance module 70, movement of the maintenance module 70 in the drum axial direction becomes possible.

Next, maintenance of the plurality of liquid discharge heads 52 of the head array 50 is performed.

Maintenance regarding one liquid discharge head 52 will be described with reference to FIGS. 9A to 9F.

Figure 9A:
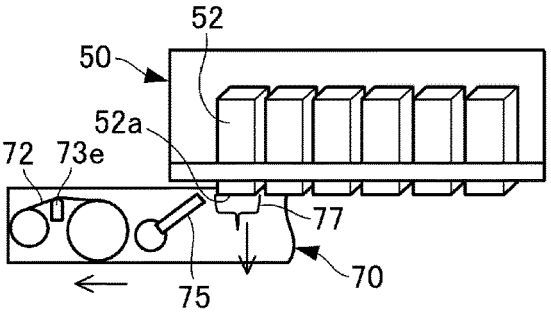
FIGS. 9A to 9F are schematic operation process diagrams of the image forming apparatus at maintenance according to the first embodiment of the present disclosure.

FIG. 9A illustrates first processing of maintenance, in which, when the maintenance module 70 is moved and the suction cap 77 corresponds to one liquid discharge head 52 that is a maintenance target, the maintenance module 70 is stopped, the head array 50 is lowered, the nozzle surface of the liquid discharge head 52 is brought in close contact with a peripheral edge portion of the suction cap 77, and the suction cap 77 performs negative pressure suction to hold the meniscus of the nozzle.

Figure 9B:
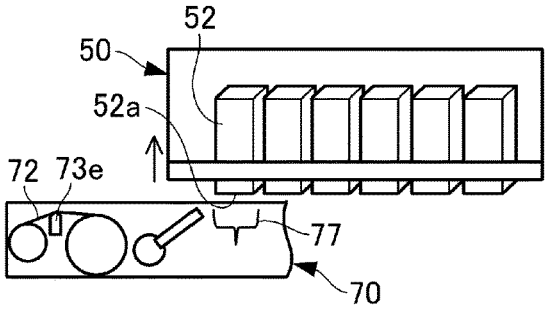

FIG. 9B illustrates an operation after holding the meniscus of the nozzle, in which the suction cap 77 stops the negative pressure suction, the head array 50 slightly rises, and the nozzle surface of the liquid discharge head 52 is separated from the suction cap 77.

Figure 9C:
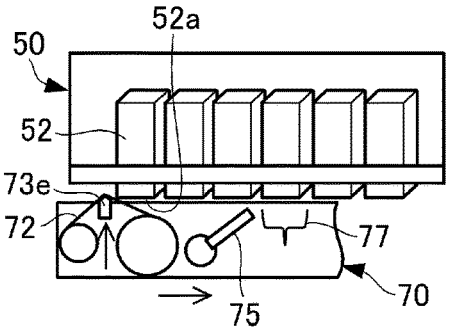

FIG. 9C illustrates a point of time when a point of time when a wiping portion of the web 72 is pushed up to a wiping position by the web pressing body 73*e*, the head array 50 is moved forward in the drum axial direction, and the liquid discharge head 52 with the held meniscus of the nozzle comes into contact with the wiping portion of the web 72, and the web 72 starts wiping.

Figure 9D:
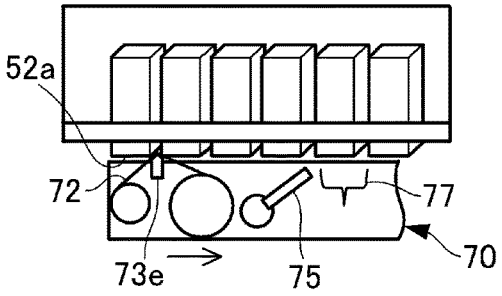

FIG. 9D illustrates a point of time when the head array 50 is continuously moved forward in the drum axial direction, the wiping portion of the web 72 terminates wiping of the nozzle surface of the liquid discharge head 52, and the head array 50 is stopped.

Figure 9E:
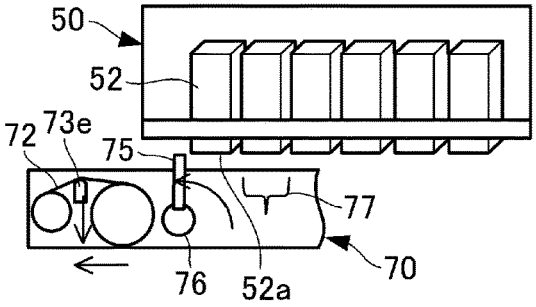

FIG. 9E illustrates a point of time when the head array 50 is moved backward in the drum axial direction, the head array 50 is stopped at a position immediately after the liquid discharge head 52, for which the web 72 has finished the wiping, has passed through the wiping position of the wiper 75, and the wiper 75 rises to the wiping position from an inclined posture by the wiper driving mechanism 76.

Figure 9F:
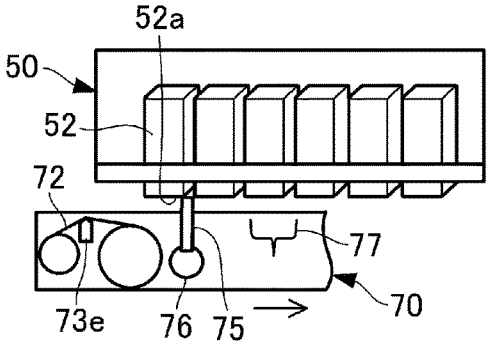

FIG. 9F illustrates a point of time when the head array 50 is moved forward in the drum axial direction, the wiper 75 terminates wiping of the nozzle surface of the liquid discharge head 52, and the head array 50 is stopped at a position immediately after the liquid discharge head 52 has passed through the wiping position of the wiper 75.

With the above operation, generation of the meniscus by the suction cap 77 and wiping of the nozzle surface by the web 72 and the wiper 75 are completed for one liquid discharge head 52.

Subsequently, maintenance of the liquid discharge head adjacent to the liquid discharge head 52 illustrated in FIG. 9A is continued after the wiper 75 is set to the inclined posture.

[Maintenance for Plurality of Liquid discharge heads 52 of Head Array 50]

There is a plurality of liquid discharge heads 52 of the head array 50, which are arranged in two lines in a staggered manner. However, it is sufficient if the liquid discharge heads 52 are processed according to a program one after another in an appropriate order. The following three ways will be described as specific processing orders.

Figure 10:
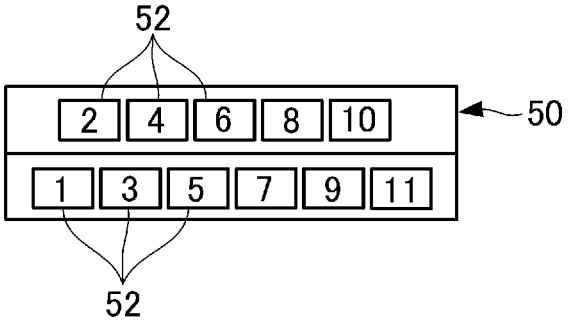
FIG. 10 is a schematic plan view illustrating a processing order of the head array of the image forming apparatus at maintenance according to the first embodiment of the present disclosure.

Maintenance according to the first processing order is to perform, as illustrated in FIG. 10, maintenance in the order indicated by Arabic numerals attached to a total of eleven liquid discharge heads 52 including six heads in a line and five heads in a line. In this processing order, maintenance of the meniscus of the nozzle by the suction cap 77, wiping by the web 72, and wiping by the wiper 75 are performed for the liquid discharge head 52 with the Arabic numeral "1", and then the maintenance of meniscus of the nozzle by the suction cap 77, wiping by the web 72, and wiping by the wiper 75 are performed for the liquid discharge head 52 with the Arabic numeral "2". In this way, the maintenance is carried out one after another in the order indicated in the Arabic numerals. Thereby, the two head arrays are alternately processed in a staggered manner. In this processing order, the lateral movement mechanism 74 laterally moves the web 72 at each maintenance for one liquid discharge head 52.

Figure 11:
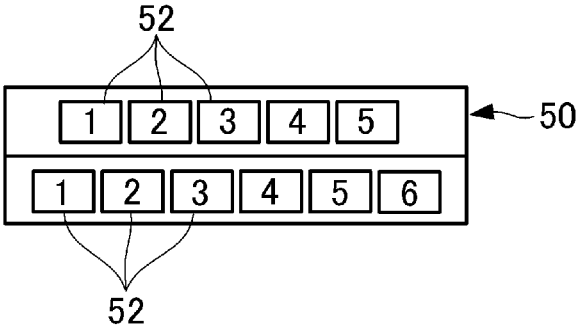
FIG. 11 is a schematic plan view illustrating another processing order of the head array of the image forming apparatus at maintenance according to the first embodiment of the present disclosure.

Maintenance according to the second processing order is to perform the maintenance of meniscus of the nozzle by the suction cap 77, wiping by the web 72, and wiping by the wiper 75 in the order indicated by Arabic numerals attached to a total of eleven liquid discharge heads 52, as illustrated in FIG. 11. In the processing order, five heads in a line are processed after six heads in a line. Therefore, the lateral movement mechanism 74 laterally moves the web 72 when changing the head array.

Maintenance according to the third processing order is to suck the nozzles 52*b* to maintain the meniscus of the nozzles 52*b* one after another by the suction cap 77, then wipe the nozzle surfaces one after another by the web 72, and then perform wiping one after another by the wiper 75, for the six liquid discharge heads 52 in a head array. Next, similarly, the maintenance of meniscus of the nozzle, wiping by the web 72, and wiping by the wiper 75 are performed for the nozzle surfaces of the five liquid discharge heads 52 in a head array. Also in this case, the lateral movement mechanism 74 laterally moves the web 72 when switching the head array.

Next, image formation (droplet discharge) is performed. The head array 50 is brought close to the peripheral surface of the conveyance drum 10 by the head array moving mechanism 60 so that a precise, uniform, and minute gap is generated between the nozzle surfaces of all the liquid discharge heads 52 of the six head arrays 50 and the peripheral surface of the conveyance drum 10. This gap is an optimum gap that enables the droplets to be discharged through the nozzle of the liquid discharge head 52 and spread on the recording medium P.

Next, the conveyance drum 10 starts conveyance rotation that is the main scanning, and the staggered two lines of liquid discharge heads 52 of the six head arrays 50 sequentially discharge the droplets to form an image on the recording medium P with the movement of the recording medium P in the main scanning direction.

Next, the image-formed recording medium P is handled by the sheet ejection roller 31 and is stacked on the sheet ejection tray 30. When image formation of the last recording medium P is completed, the conveyance drum 10 switches the conveyance rotation speed to the speed to eject sheets, and the image-formed recording medium P is handled by the sheet ejection roller 31 and stacked on the sheet ejection tray 30.

Thereafter, in the case where sheet feeding is not performed and image formation is not performed, the head array 50 is retracted to a position away from the peripheral surface of the conveyance drum 10 by the head array moving mechanism 60, and the maintenance module 70 is moved from the rear position in the drum axial direction to a position corresponding to the peripheral surface of the conveyance drum 10 as an initial position and stopped by the maintenance module moving mechanism 80. Then, the head array 50 is brought close by a slight dimension to the maintenance module 70 by the head array moving mechanism 60 so that the head array 50 is retracted to a position away from the peripheral surface of the conveyance drum 10, the liquid discharge head 52 is brought into close contact with the moisturizing cap 78, and moisture retention of the end surface of the nozzle of the liquid discharge head 52 is maintained.

As described above, according to the image forming apparatus and the liquid discharge apparatus of the above embodiment, the maintenance module 70 is disposed on the peripheral surface of the conveyance drum 10, the head array 50 is disposed outside the maintenance module 70, the maintenance module 70, which can be relatively lightly configured, is moved rearward in the drum axial direction, and the very heavy head array 50 is moved close to the peripheral surface of the conveyance drum 10. Therefore, since the stroke of the head array 50 is greatly shortened, the takt time can be kept equal to a conventional takt time even if the moving speed of the head array 50 is greatly reduced. Therefore, there is an excellent effect to be able to adopt a space-saving and low-cost electric or electromagnetic linear actuator or motor.

Furthermore, according to the image forming apparatus and the liquid discharge apparatus of the above-described embodiment, the maintenance module 70 is disposed on the peripheral surface of the conveyance drum 10, and the web 72 and the wiper 75 are located close to the front side of the apparatus. Therefore, there is an effect to easily replace the web 72 and clean the wiper 75.

Second Embodiment

Figure 12:
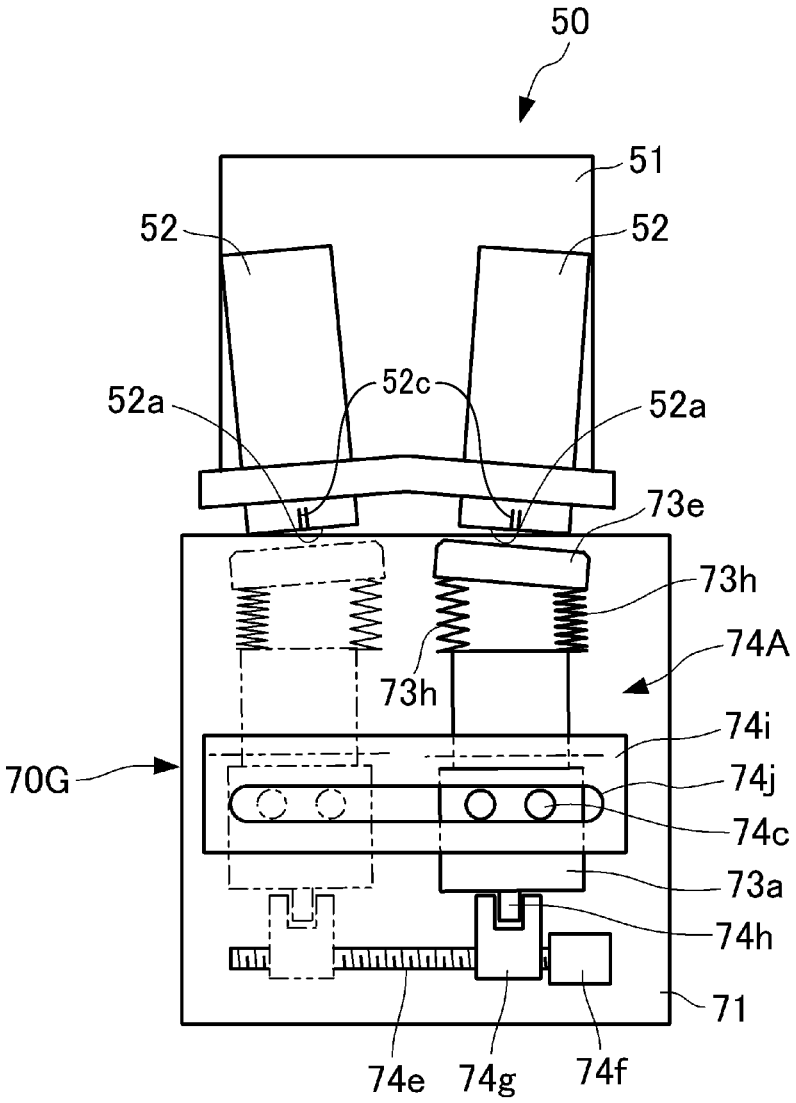
FIG. 12 is a partial vertical cross-sectional view of a liquid discharge apparatus of an image forming apparatus according to a second embodiment of the present disclosure.

FIG. 12 illustrates a configuration of a main portion when wiping is performed by a web of an image forming apparatus and a liquid discharge apparatus of a second embodiment of the present disclosure. FIG. 12 corresponds to FIG. 7 of the first embodiment, and the same configuration is denoted by the same reference numeral, and description of the configuration and operation is omitted.

Different points are that a linear guiding portion 74*i* including a linear slit 74*j* is included in place of the arc-shaped guide portion 74*a*, a lateral movement mechanism 74A that laterally and linearly moves a web 72 is included, and the degree of freedom in posture of a web pressing body 73*e* is achieved by a coupling holding portion (spring) 73*h* between a bracket 73*a* and the web pressing body 73*e*.

The lateral movement mechanism 74A includes a screw shaft 74*e*, a lateral movement motor 74*f*, a block 74*g*, and a coupling projection 74*h* as the same configurations as the lateral movement mechanism 74 of the first embodiment. The lateral movement mechanism 74A linearly guides a projection 74*c* provided on the bracket 73*a* with the linear slit 74*j* (linear guiding portion). With the configuration, the lateral movement mechanism 74A linearly guides the bracket 73*a* on two positions corresponding to one head array and the other head array in a staggered manner of liquid discharge heads 52.

Since a maintenance module 70G includes the lateral movement mechanism 74A that laterally moves the web 72, the web 72 having a width corresponding to one line of staggered liquid discharge heads 52 can wipe nozzle surfaces of one line of staggered liquid discharge heads 52 by a web pressing mechanism 73 and can be laterally moved by the lateral movement mechanism 74A, to wipe the nozzle surfaces of the other one line of liquid discharge heads 52. At this time, since the web pressing body 73*e* held by the coupling holding portion (spring) 73*h* has the degree of freedom in posture, when the bracket 73*a* is laterally moved by the lateral moving mechanism 74A, the web pressing body 73*e* can correspond to the angles of the nozzle surfaces of the other line of liquid discharge heads 52, whereby the web 72 can favorably come in close contact with and wipe the nozzle surfaces of the liquid discharge heads 52.

Third Embodiment

Figure 13:
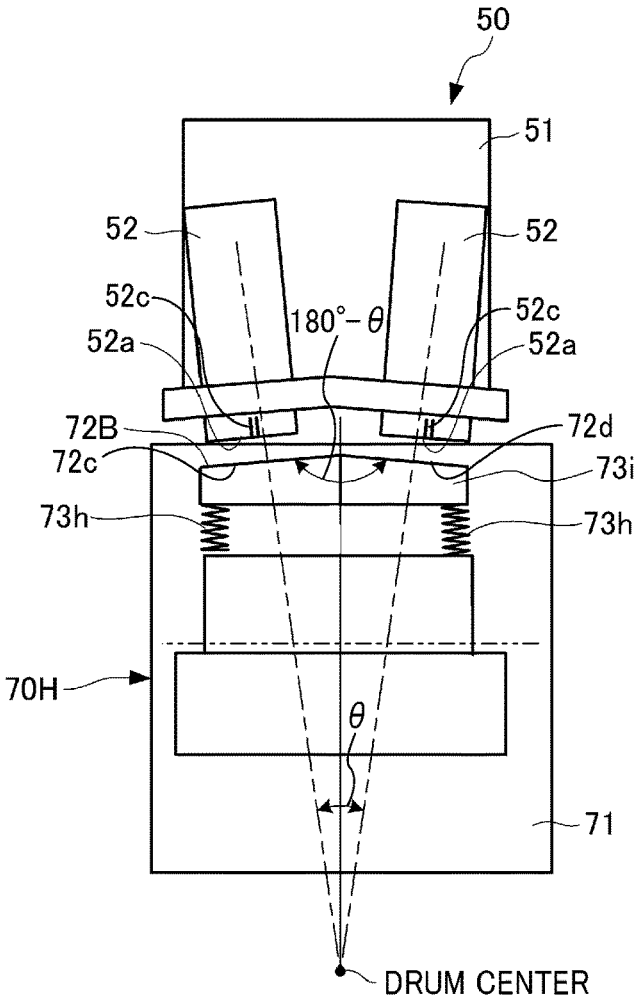
FIG. 13 is a partial vertical cross-sectional view of a liquid discharge apparatus of an image forming apparatus according to a third embodiment of the present disclosure.
Figure 14:
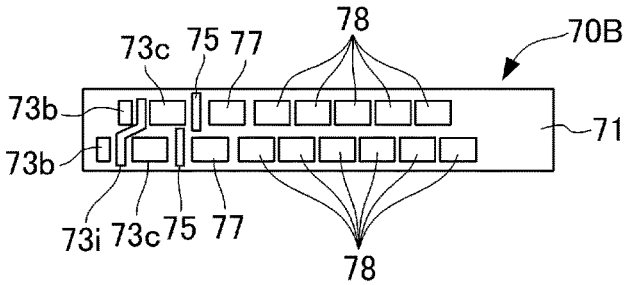
FIG. 14 is a schematic plan view of a maintenance module of the image forming apparatus according to the third embodiment of the present disclosure.

FIG. 13 illustrates a configuration of a main portion when wiping is performed by a web of an image forming apparatus and a liquid discharge apparatus of a third embodiment of the present embodiment, and is a view corresponding to FIG. 7 of the first embodiment. FIG. 14 illustrates a maintenance module 70H, which corresponds to FIG. 5 of the first embodiment. In FIGS. 13 and 14, the same configuration is denoted by the same reference numeral in comparison with FIGS. 5 and 7, and description of the configuration and operation is omitted.

In FIGS. 13 and 14, the maintenance module 70H has a configuration in which a web 72B and a web pressing body 73*i* are not laterally moved, which is different from the first embodiment. A web 72B has a width to wipe a nozzle surface 52*a* of a liquid discharge head 52 in one line of a head array 50 and a nozzle surface 52*a* of a liquid discharge head 52 in the other line at the same time. The web pressing body 73*i* is attached to a bracket 73*a* that holds the web 72B, and is moved in a pressing direction at maintenance and brings the web 72B to wipably come in close contact with both the nozzle surfaces 52*a* with different angles from each other of the liquid discharge heads 52 in one line and in the other line.

The staggered two lines (arrays) of liquid discharge heads 52 are radially arranged on an outer periphery of a conveyance drum, and extended lines of nozzle centers intersect with each other at a drum center to form an angle θ as viewed in a drum axial direction of when the liquid discharge heads 52 come close to the peripheral surface of the conveyance drum to cause a discharge gap. Accordingly, inclined surfaces inclined at two directions by an obtuse angle (180°-θ) are provided in a lower surface of the head array 50. The difference of the angle θ is provided also in two lines of webs and wipers of the maintenance module 70H in accordance with the two inclined surfaces of the liquid discharge heads 52. Here, to make the number of webs 72B be one, the web 72B is made wide in width, and an end portion of the web pressing body 73*i* is formed into an inverted V-shape with an obtuse angle (180°-θ) such that the webs 72B match the inclination of the nozzle surfaces of the two lines of liquid discharge heads 52.

Thus, the wiper includes a plurality of wiping surfaces to wipe nozzle surfaces 52*a* of the plurality of liquid discharge heads 52 of the plurality of head arrays 50, respectively, the nozzles 52*b* are formed on the nozzle surfaces 52*a*, and the plurality of wiping surfaces 72*c* and 72*d* is inclined at the different angles in accordance with an inclination of the plurality of head arrays 50, respectively.

The wiper includes a web 72B having a width to cover the plurality of wiping surfaces 72*c* and 72*d* to simultaneously wipe the nozzle surfaces 52*a* of the plurality of liquid discharge heads 52 of the plurality of head arrays 50, and the web pressing mechanism 73 to press the web 72B against the nozzle surfaces 52*a* of the plurality of liquid discharge heads 52 of the plurality of head arrays 50 inclined at different angles.

In the present embodiment, the web 72B can wipe the nozzle surface of the liquid discharge head 52 in one line of the head array 50 and the nozzle surface of the liquid discharge head 52 in the other line at the same time with the forward movement of the maintenance module 70 in the drum axial direction, and a mechanism to laterally move the web is unnecessary and not provided.

Figure 15:
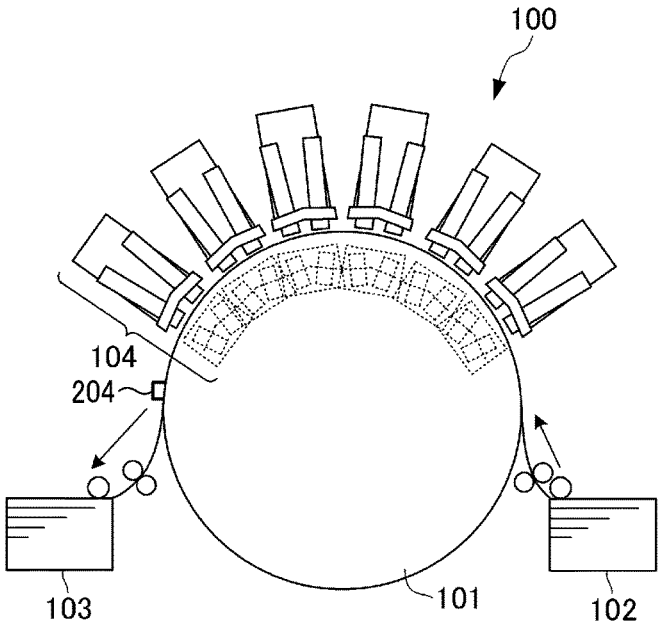
FIG. 15 is a schematic front view of an image forming apparatus of a comparative example.
Figure 16:
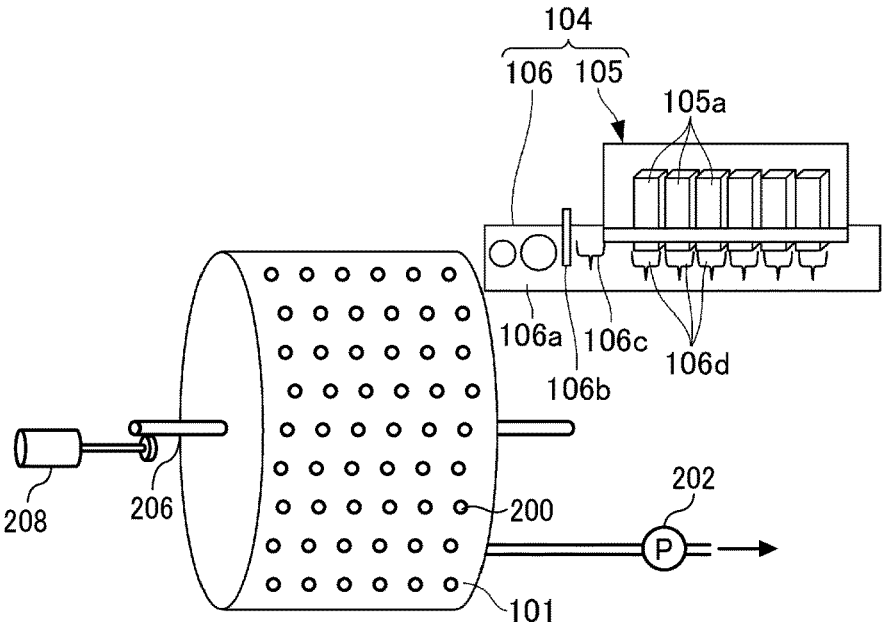
FIG. 16 is a schematic side view of the image forming apparatus at non-image formation timing (when an image is not formed) of the comparative example.
Figure 17:
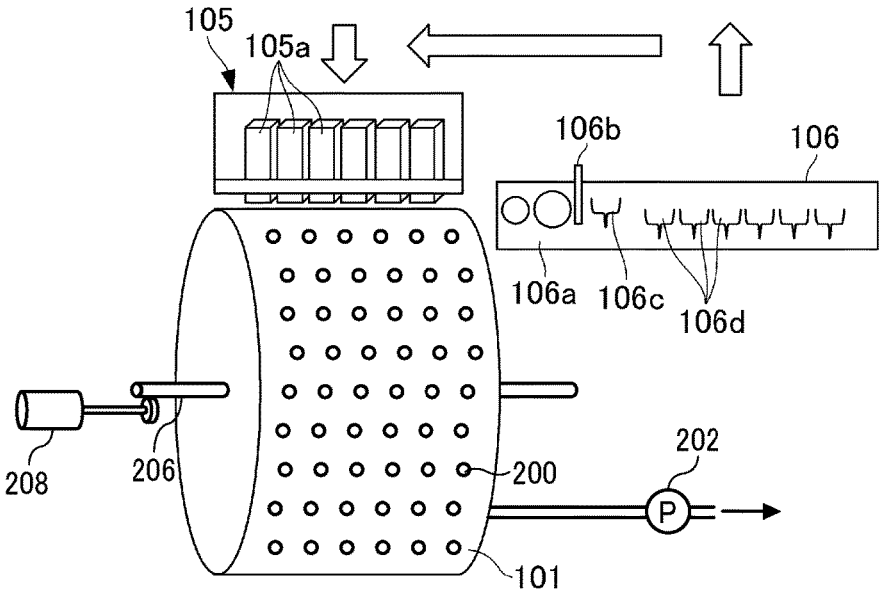
FIG. 17 is a schematic side view of the image forming apparatus at image formation (at liquid discharge timing) of the comparative example.

FIGS. 15 through 17 illustrate a configuration in a comparative example.

FIG. 15 is a schematic front view of an image forming apparatus of the comparative example. FIG. 16 is a schematic side view of the image forming apparatus at non-image formation timing (when an image is not formed) of the comparative example. FIG. 17 is a schematic side view of the image forming apparatus at image formation (at liquid discharge timing) of the comparative example.

As illustrated in FIG. 15, an image forming apparatus 100 includes a conveyance drum 101 that holds and conveys a recording medium (medium) P on a peripheral surface at image recording, a sheet feed tray 102 on which the recording medium P is stacked, and which feeds the recording medium P to the conveyance drum 101, a sheet ejection tray 103 that receives and stacks the recording medium P on which an image has been recorded and conveyed on the peripheral surface of the conveyance drum 101, and a liquid discharge apparatus 104 that discharges droplets on the recording medium P held on the peripheral surface of the conveyance drum 101. The liquid discharge apparatus 104 includes a head array 105 and a maintenance module 106. The head array 105 includes plurality of liquid discharge heads 105*a*, and the maintenance module 106 includes a web 106*a*, a wiper 106*b*, a suction cap 106*c*, and a moisturizing cap 106*d*.

The maintenance module 106 in FIGS. 16 and 17 has a configuration similar to the configuration of the maintenance module 70 in FIGS. 2 and 3 of the present embodiment. However, the maintenance module 106 of the comparative example does not include the maintenance module moving mechanism 80 of the present embodiment.

The image forming apparatus 100 of the comparative example moves the head array 105 horizontally to the position to the maintenance module 106 to maintenance the liquid discharge heads 105*a* with the maintenance module 106. Thus, the image forming apparatus 100 of the comparative example cannot easily perform replacement of the web and cleaning of the wiper at a low cost.

Conversely, according to the present embodiment, there is an effect to easily perform replacement of the web and cleaning of the wiper at a low cost. Therefore, the present embodiment is excellent in a liquid discharge apparatus and an image forming apparatus for discharging droplets on a recording medium held on a peripheral surface of a conveyance drum from a plurality of liquid discharge head arrays radially arranged on an outer periphery of the conveyance drum to form an image.

In the present embodiment, the "liquid discharge head" is a functional component that discharges and injects droplets through a nozzle 52*b*. The liquid discharged as droplets is not particularly limited as long as the liquid has viscosity and surface tension dischargeable through the head, and the viscosity is favorably 30 mPa·s or less at normal temperature and normal pressure or by heating and cooling. More specifically, examples of the liquid include a solution, a suspension, or an emulsion containing water and a solvent such as organic solvent, a colorant such as a dye and a pigment, a polymerizable compound, a resin, a function-imparting material such as a surfactant, a biocompatible material such as DNA, an amino acid, protein, or calcium, and an edible material such as a natural coloring matter. For example, these liquids can be used for an inkjet ink, a surface treatment liquid, a liquid for forming a constituent element of an electronic element or a light emitting element, or an electronic circuit resist pattern, a material solution for 3D modeling, and the like.

In the present embodiment, the liquid discharge apparatus includes a head array, head array operation means including a mechanism to move the head array and a driving mechanism to drive a liquid discharge head to discharge a liquid, a maintenance module including a functional component to maintain the liquid discharge head and maintain moisture, and a maintenance module mechanism to move the maintenance module.

Further, the liquid discharge apparatus includes not only a device capable of discharging a liquid to a liquid-attachable material but also a device to discharge a liquid toward air or liquid. Therefore, the liquid discharge apparatus includes not only the case adopted to the image forming apparatus but also to the case adopted to a three-dimensional modeling apparatus, a treatment liquid application apparatus, or an injection granulation apparatus. Further, the liquid discharge apparatus includes a treatment liquid application device for discharging a treatment liquid onto the surface of paper for applying the treatment liquid to the surface of paper for the purpose of, for example, modifying the surface of paper, or an injection granulation apparatus for injecting a composition liquid obtained by dispersing a raw material in a solution through a nozzle to granulate fine particles of the raw material.

The above "liquid-attachable material" means a material to which the liquid can be at least temporarily attached, or a material to which the liquid is attached and infiltrated, or the like. Specific examples of the liquid-attachable material include a medium to be recorded such as a sheet, a recording paper, a film, or cloth, an electronic substrate, an electronic component such as a piezoelectric element, a powder layer, an organ model, and a medium such as an inspection cell. Everything to which a liquid is attached is included unless otherwise particularly limited. The material of the "liquid-attachable material" may be any material as long as a liquid is even temporarily attached, such as paper, thread, fiber, cloth, leather, metal, plastic, glass, wood, or ceramics.

Further, the "device to discharge a liquid" includes a device in which the liquid discharge head and the liquid-attachable material are relatively moved. However, the "device to discharge a liquid" is not limited to the above device. Specific examples include a serial-type device that moves a liquid discharge head, and a line-type device that does not move a liquid discharge head.

The present embodiment also includes an embodiment provided with at least one head array 50. Further, the present embodiment includes, in the case of a configuration in which the number of the head arrays 50 is a few, such as two or three, a configuration to integrate the head array bodies 51 of the head arrays 50 such that the extended lines of the central lines of the nozzles 52*b* pass through the drum center when the liquid discharge heads 52 of the head arrays 50 are brought close to the conveyance drum 10 and placed at liquid discharge positions, and to cause the integrated head arrays 50 to approach or to be separated from the conveyance drum 10.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge apparatus comprising:

a plurality of head arrays each including a plurality of liquid discharge heads to discharge a liquid from nozzles onto a medium;

a drum to rotate and convey the medium to a position facing the plurality of head arrays; and a wiper to wipe the plurality of liquid discharge heads;

wherein each of the plurality of head arrays includes at least two lines of the plurality of liquid discharge heads spaced over a circumferential portion of the drum, and the plurality of liquid discharge heads are inclined at different angles in each of the two lines, and the wiper includes a web having a width to cover the two lines of the plurality of liquid discharge heads, and the web includes a plurality of wiping surfaces inclined at the different angles in accordance with the two lines of the plurality of liquid discharge heads.

2. The liquid discharge apparatus according to claim 1, wherein the wiper includes:

a pressing mechanism to press the web against the nozzle surfaces of the plurality of liquid discharge heads of the plurality of head arrays inclined at the different angles.

3. The liquid discharge apparatus according to claim 2, wherein the web includes nonwoven fabric.

4. The liquid discharge apparatus according to claim 1, further comprising:

a first driver to drive the wiper to move in an axial direction of the drum between a discharge position and a non-discharge position, the wiper being disposed between the plurality of head arrays and the drum at the non-discharge position and disposed offset from the drum in the axial direction at the discharge position; and a second driver to drive the plurality of head arrays to move in a direction approaching to the drum at the discharge position and in a direction separating from the drum at the non-discharge position.

5. An image forming apparatus comprising:

the liquid discharge apparatus according to claim 1 to discharge the liquid from the plurality of liquid discharge heads onto the medium to form the image on the medium conveyed by the drum;

a sheet feed tray to feed the medium to the drum; and a sheet ejection tray to receive the medium conveyed by the drum.

6. The liquid discharge apparatus according to claim 1, wherein the plurality of liquid discharge heads are inclined at different angles in each of the two lines to face a center of the drum.

7. A liquid discharge apparatus comprising:

a plurality of head arrays each including a plurality of liquid discharge heads to discharge a liquid from nozzles onto a medium;

a drum to rotate and convey the medium to a position facing the plurality of head arrays; and a wiper including a web to wipe nozzle surfaces of the plurality of liquid discharge heads, wherein each of the plurality of head arrays includes at least two lines of the plurality of liquid discharge heads spaced over a circumferential portion of the drum, and the plurality of liquid discharge heads are inclined at different angles in each of the two lines, and, the nozzles being formed on the nozzle surfaces, the web having a width to cover the two lines of the plurality of liquid discharge heads, and the wiper includes a moving mechanism to move the web from a first position facing one of the two lines of the plurality of liquid discharge heads to a second position facing another one of the two lines of the plurality of liquid discharge heads inclined at a different angle.

8. The liquid discharge apparatus according to claim 7, wherein the moving mechanism includes an arc-shaped guide portion to guide the web in an arc manner between the first position and the second position.

9. The liquid discharge apparatus according to claim 7, wherein the moving mechanism includes a linear guiding portion to linearly guide the web between the first position and the second position.

10. The liquid discharge apparatus according to claim 7, wherein the web includes nonwoven fabric.

11. The liquid discharge apparatus according to claim 7, further comprising:

a first driver to drive the wiper to move in an axial direction of the drum between a discharge position and a non-discharge position, the wiper being disposed between the plurality of head arrays and the drum at the non-discharge position and disposed offset from the drum in the axial direction at the discharge position; and a second driver to drive the plurality of head arrays to move in a direction approaching to the drum at the discharge position and in a direction separating from the drum at the non-discharge position.

12. An image forming apparatus comprising:

the liquid discharge apparatus according to claim 7 to discharge the liquid from the plurality of liquid discharge heads onto the medium to form the image on the medium conveyed by the drum;

a sheet feed tray to feed the medium to the drum; and a sheet ejection tray to receive the medium conveyed by the drum.

13. The liquid discharge apparatus according to claim 7, wherein the plurality of liquid discharge heads are inclined at different angles in each of the two lines to face a center of the drum.

* * * * *